United States Patent [19]

Nicoud et al.

[11] 4,151,896

[45] May 1, 1979

[54] METHOD OF PRODUCING MACHINE WIRE BY CONTINUOUS CASTING AND ROLLING

[75] Inventors: Jean C. Nicoud, Saint Egreve; Paul Faivre, Feyssinet, both of France

[73] Assignee: Societe de Vente de l'Aluminium Pechiney, Paris, France

[21] Appl. No.: 870,923

[22] Filed: Jan. 19, 1978

[30] Foreign Application Priority Data

Feb. 2, 1977 [FR] France ..... 77 03529

[51] Int. Cl.[2] ..... C22F 1/04

[52] U.S. Cl. ..... 148/2; 148/11.5 A

[58] Field of Search ..... 148/2, 11.5 A, 12.7 A, 148/32, 32.5, 158

[56] References Cited

U.S. PATENT DOCUMENTS

| | | | |
|---|---|---|---|
| 3,418,177 | 12/1968 | Pryor | 148/12.7 A |
| 3,613,767 | 10/1971 | Cofer | 164/87 |
| 3,836,405 | 9/1974 | Staley et al. | 148/12.7 A |
| 3,911,819 | 10/1975 | Pryor et al. | 148/32 |
| 4,019,931 | 4/1977 | Setzer et al. | 148/12.7 A |

*Primary Examiner*—L. Dewayne Rutledge
*Assistant Examiner*—Peter K. Skiff
*Attorney, Agent, or Firm*—Dennison, Dennison, Meserole & Pollack

[57] ABSTRACT

A method and apparatus for casting and rolling and heat treatment for aluminum alloys with structural hardening, which are continuously cast and rolled to produce machine wire, comprising, carrying out a first rolling operation at a reduction rate of 20 to 85% on discharge from the casting machine, continuously reheating the already rolled blank to bring it to a temperature between 450° and 550° C., then carrying out final hot rolling to the definitive section of the machine wire. The method applies particularly to the production of wire made of aluminum alloy Al-Mg-Si for the manufacture of electrical conductors.

5 Claims, 1 Drawing Figure

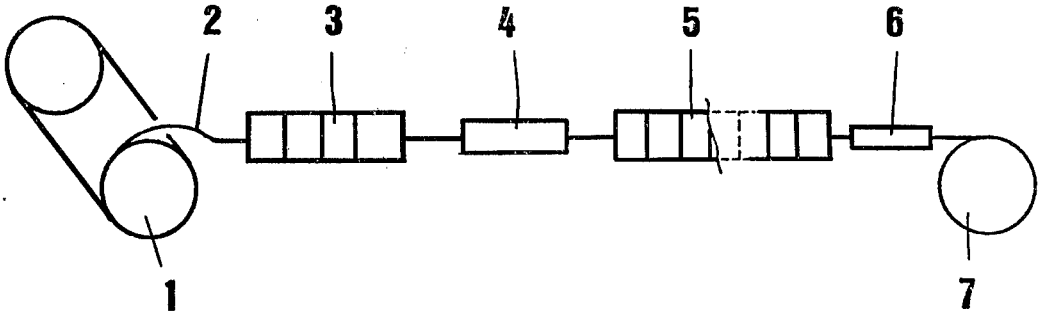
2
3
4
5
6
1
7

METHOD OF PRODUCING MACHINE WIRE BY CONTINUOUS CASTING AND ROLLING

The invention concerns a new technique of rolling and heat treatment for the manufacture of machine wire made of aluminum alloy with structural hardening, more particularly conductive Al-Mg-Si alloy.

In the Al-Mg-Si alloy for electrical conductors, hereinafter referred to as A-GS/L, the main addition elements are: iron 0.15 to 0.30%; magnesium 0.30 to 0.85%; silicon 0.30 to 0.70%; and copper $\leqq 0.20\%$.

Machine wire made of A-GS/L may be manufactured either by extruding round billets on an extrusion press or by hot rolling square billits, or by a last process which has virtually supplanted the two others: continuous casting followed by hot rolling. This process consists of casting a blank of generally trapezoidal shape between the groove in a casting wheel and a metal strip, both cooled, the blank then being rolled either in mills consisting of grooved rollers or in cages consisting of three rollers at 120° to one another. On leaving the mill, the machine wire is wound on a reel. This process has been developed considerably for economic reasons. It does require a relatively small investment and enables reels of high unit weight to be produced continuously.

However, the machine wire obtained by this last process has properties slightly inferior to those of wire produced by the first two methods, for the hot working is not sufficient to allow the cast structure to be totally eliminated.

This is not always of great importance, for A-GS/L is a heat treatment alloy, and the wire has to undergo solution heat, quenching and tempering treatment in order to obtain the mechanical properties required of the cables for which it is used.

One method of carrying out the heat treatment comprises placing the reels of wire in a furnace to obtain a solution at a temperature between 500° and 580° C., and quenching them with cold water. The wire is then drawn and tempering is carried out at the final diameter stage.

In this method the wire undergoes complete recrystallization in the course of the solution heat treatment, which is very favorable to its subsequent drawing capacity. This treatment guarantees combinations of mechanical strength and electrical conductivity which will be high enough for the manufacture of overhead cables satisfying standard NF C 34 125 ($R > 32.4$ kg/mm2 and $\rho \leqq 3.28$ $\mu\Omega$.cm for wires less than 3.6 mm in diameter before cabling.)

However, the method has certain disadvantages: it is a discontinuous operation carried out on reels, and therefore interrupts the continuous production cycle, from the liquid metal to the wire. In addition, it is difficult to obtain an identical metallurgical state on every single turn of a reel, since the times for which the turns are in position and the quenching speeds vary considerably from an external turn to an internal one.

For these reasons, it is more advantageous to use the apparatus described in French Pat. No. 2,261,816 after the mill. This enables the wire emerging from the mill to be cooled rapidly to a temperture below 150° C.

However, if the quenching is to be effective enough to guarantee good mechanical and electrical properties in the drawn, tempered wire, it is necessary to avoid precipitating too many hardening elements ($Mg_2Si$ in this case) during the operation of transferring the solidified blank to the mill and the rolling operation. This requires a high temperature for the blank leaving the casting wheel and therefore casting conditions which are hard on the plant in the absence of any heating between the casting wheel and the mill. Furthermore, even under these high temperature conditions, the machine wire has a fibrous, nonrecyrstallized structure.

Applicants have discovered a process which enables these difficulties to be resolved. The principle is to follow up a first rolling operation with continuous reheating of the blank. This makes it possible both to recrystallize the blank partially or preferably totally before the subsequent rolling, and to put again in solution the hardening elements which have precipitated during the transfer of the blank or during its passage into the first mill.

The single FIGURE of the drawing shows schematically an installation for carrying out the process and wherein the elements comprise:

(a) a casting wheel 1 fed with liquid metal, which solidifies into a trapezoidal blank ranging, e.g., from 900 $mm^2$ to 5000 $mm^2$ in section. The blank is shown diagrammatically at 2 where it passes to (b) a roughing mill 3 generally comprising a plurality of successive cages either of the grooved roller or the three roller mill type known in the art. The total reduction of the mill (So-S)/So is from 20% to 85% and preferably from 30% to 70%, So being the section of the blank on entering the mill 3 and S the section of the blank on leaving the mill 3. The temperature at which the blank enters the mill is over 440° C.

(c) a rapid heating arrangement or furnace 4 located immediately at the outlet from the first mill, for increasing the temperature of the blank by 30° to 150° C. and keeping it between 450° and 550° C. and preferably between 480° and 530° C. (the range within which the magnesium and silicon are totally in solid solution at equilibrium within the formulation limits defined above.) The continuous heating may take place in one or more zones and may be applied by any known method, e.g., the Joule effect, or an induction furnace, a fuel heated furnace or one with electrical resistors. The heating power is preferably subject to the temperature at which the blank leaves the furnace.

(d) a second, finishing mill 5 also consisting of a plurality of successive cages provided to reduce the section of the blank to the final section of the wire. This second mill is 4 to 15 meters away from the preceding furnace 4.

(e) a continuous installation 6 for cooling the wire to a temperature below 200° C. and preferably below 150° C. (the temperature above which there is marked precipitation of $Mg_2Si$).

(f) a winding frame or reel 7.

As compared with a conventional installation for continuous casting and rolling, this amounts to cutting the rolling line after a reduction of 20% to 85% and placing a furnace to raise the temperature of the blank between the upstream part and the downstream part. Machine wire made of A-GS/L usually 9.5mm in diameter, which is produced by this method and, more generally, wires made of alloy with structural hardening, e.g. for mechanical uses, have the following properties as compared with present day machine wires: an improvement in texture, i.e., a reduction in grain size by total or partial recrystallization in the course of hot rolling; an increase in elongation and in the plastic range (between the elastic limit and the breaking load) owing to the reduction in residual work hardening; and reduction in external segregation, (these three factors give the machine wire improved drawability); more complete placing in solution of the addition elements involved in structural hardening during the subsequent tempering operation, and hence an increase, with equal resistivity, in the breaking load on the drawn and tempered wire; and a possible reduction in casting temperature and consequently a reduction in casting stresses, a reduction in solidification internal defects and an improvement in the maintenance of the casting equipment.

The examples which follow illustrate the advantages obtained by the method of the invention.

EXAMPLE I

Prior art treatment with a liquid metal containing 0.25% Fe; 0.57% Si; 0.54% Mg; and the remainder aluminum; a blank 2400 $mm^2$ in section is cast at 720° C. on a casting wheel. The blank emerges at 470° C. at a speed of approximately 10 meters per minute. The blank is then fed into a mill consisting of seventeen successive cages, each cage being equipped with three rollers at 120° to one another. The blank is thus gradually transformed into a substantially round wire 9.5 mm in diameter.

On leaving the last cage the wire is cooled rapidly to 80° C. using apparatus in accordance with French Pat. No. 2,261,816, and wound onto a reel.

The machine wire thus obtained is then drawn to a final diameter of 3 mm without any intermediate heat treatment, then undergoes three hours' tempering treatment at 165° C.

EXAMPLE II

Treatment according to the present invention: Using the same liquid metal composition, a trapezoidal blank 2400 $mm^2$ in section is cast at 720° C. on a casting wheel in the same way as in the previous example. The blank again emerges at 470° C. at a speed of approximately 10 meters per minute. It passes next into a first rolling unit comprising four cages, which produces a reduction (So −S/So) of approximately 70%, and from which it emerges at a speed of approximately 0.5 meters per second.

The blank then passes into an induction furnace where its temperature is increased by 80° passing from 410° to 490° C. After being held there for five seconds, it undergoes finishing rolling on a mill composed of thirteen successive cages which bring the diameter of the wire to 9.5 mm. On leaving the line and before being wound onto a reel, the wire is quenched continuously at a temperature of 80° C. The machine wire is then drawm to its final diameter of 3 mm as in the previous case and undergoes three hours' tempering treatment at 165° C.

EXAMPLE III

Treatment according to the present invention: Using the same liquid metal composition, a trapezoidal blank 2400 $mm^2$ in section is cast at 720° on a casting wheel in the same way as in the previous example. The blank emerges again at 470° C. at a speed of approximately 10 meters per minute. It passes next into a first rolling unit composed of four cages effecting a reduction (So −S/So) of approximately 70%, from which it emerges at a speed of approximately 0.5 meters per second.

The blank passes next into an induction furnace where its temperature is increased by 110°, bringing it from 410° to 520° C. After being kept there for five seconds, it undergoes finishing rolling on a mill composed of thirteen successive cages which bring the diameter of the wire to 9.5 mm. On leaving the line and before being wound onto a reel, the wire is quenched continuously at 80° C. The machine wire is then drawn to its final diameter of 3 mm as in the previous case and undergoes three hours' tempering treatment at 165° C.

The mechanical properties were determined on the machine wire and the drawn wire in Examples I, II and III. The results are set out in the tables below. R represents the breaking load in $kg/mm^2$; A represents elongation at rupture as a percent; $\rho$ represents resistivity in $\mu\Omega$.cm; and C represents conductivity as % IACS (International Annealed Copper Standard).

| MACHINE WIRE 9.5 mm | R $kg/mm^2$ | $A_{200}$% | $\rho$ $\mu\Omega$ . cm |
|---|---|---|---|
| Example I (prior art) | 19.1 | 13.3 | 3.350 |
| Example II (invention annealed at 490° C.) | 18.5 | 18.6 | 3.440 |
| Example III (invention annealed at 520° C.) | 18.6 | 19.1 | 3.450 |

| DRAWN AND TEMPERED WIRE 3mm | R $kg/mm^2$ | $A_{20}$% | $\rho$ $\mu\Omega$ . cm | C % IACS |
|---|---|---|---|---|
| Example I (prior art) | 32.2 | 7.5 | 3.184 | 54.1 |
| Example II (invention annealed at 490° C.) | 35.2 | 6.0 | 3.915 | 54.0 |
| Example III (invention annealed at 520° C.) | 35.8 | 6.1 | 3.207 | 53.8 |

It will be noted that in the machine wire state the slightly lower breaking load and the markedly greater elongation results from the intermediate recrystallization of the wire. The higher resistivity of the wire according to the invention results from the improved placing in solution of the hardening elements ($Mg_2Si$); the elements in solid solution are in fact known to increase the resistivity of aluminum.

On the other hand, with the drawn and tempered wire (state T.8) all the mechanical and electrical properties of the wire according to the invention are better, and the higher the intermediate annealing temperature the better these properties are.

Although the description and examples concern Al-Mg-Si alloy, the method of the invention can be applied to any aluminum alloys with structural hardening, particularly those of series 2000 (aluminum-copper-magnesium), 7000 (aluminum-zinc-magnesium-copper) and 4000 (aluminum-magnesium-silicon).

We claim:

1. A method of continuous casting, heat treatment and rolling of aluminum alloys with structural hardening for producing machine wire, having improved elongation comprising casting a continuous blank from molten alloy on a casting wheel, subjecting the emerging continuous blank to the following steps in sequence;

(a) a first hot rolling at a feed temperature of above 440° C. to cause the initial section of the blank (So)

to change to a section (S) so that (So −S/So) is from 20 to 85%, (b) increasing the temperature of the blank emerging from the first hot rolling by from 30° to 150° C., enabling it to be brought to a temperature of between 450° to 550° C., and hold for about 5 seconds and thus causing the hardening elements of the alloy to go into solution and recrystallize, (c) passing the blank through a second hot rolling to further reduce the section (S) of the blank to a final section ($S_F$).

2. A method as defined in claim 1 and further including the step of continuous quenching subsequent to the second hot rolling step.

3. A method as defined in claim 1 wherein the aluminum alloy is an aluminum-magnesium-silicon alloy containing as its chief elements, apart from aluminum, from 0.15 to 0.30% iron, from 0.30 to 0.80% magnesium, from 0.30 to 0.70% silicon and no more than 0.2% copper.

4. A method as defined in claim 2 and further including the step of winding the quenched wire on a reel.

5. A method as defined in claim 1 wherein said temperature is increased to between 480° and 530° C.

* * * * *